United States Patent [19]

Sudweeks et al.

[11] 4,231,821

[45] Nov. 4, 1980

[54] EMULSION BLASTING AGENT SENSITIZED WITH PERLITE

[75] Inventors: Walter B. Sudweeks, Orem; Larry D. Lawrence, Salt Lake City, both of Utah

[73] Assignee: IRECO Chemicals, Salt Lake City, Utah

[21] Appl. No.: 41,154

[22] Filed: May 21, 1979

[51] Int. Cl.[3] ..... C06B 45/02

[52] U.S. Cl. ..... 149/21; 149/2; 149/46; 149/61

[58] Field of Search ..... 149/21, 2, 46, 61

[56] References Cited

U.S. PATENT DOCUMENTS 3,252,843 5/1966 Griffith et al. ..... 149/46 X

*Primary Examiner*—Stephen J. Lechert, Jr.

[57] ABSTRACT

The invention relates to cap-sensitive water-in-oil emulsion blasting agents having a discontinuous aqueous phase, a continuous oil or water-immiscible liquid organic phase, an emulsifier, and perlite of fine particle size.

11 Claims, No Drawings

EMULSION BLASTING AGENT SENSITIZED WITH PERLITE

The present invention relates to improved explosive compositions. More particularly, the invention relates to water-in-oil emulsion blasting compositions having a discontinuous aqueous phase and a continuous oil or water-immiscible liquid organic phase. The compositions comprise (a) discrete droplets of an aqueous solution of inorganic oxidizer salt(s), (b) a water-immiscible liquid organic fuel forming a continuous phase throughout which the droplets are dispersed, (c) an emulsifier that forms an emulsion of the oxidizer salt solution droplets throughout the continuous liquid organic phase, and (d) perlite of a fine particle size. The use of perlite of fine particle size renders the composition cap-sensitive. As used herein, the term "cap-sensitive" means that the composition is detonable with a No. 8 cap at 20° C. in a charge diameter of 32 mm or less.

Aqueous blasting compositions or slurries generally have a continuous aqueous phase throughout which immiscible liquid hydrocarbon fuel droplets or solid ingredients may be dispersed. In contradistinction, the compositions of the present invention have a continuous oil phase throughout which discrete droplets of aqueous solution are dispersed.

Water-in-oil emulsion blasting agents are known in the art. See, for example, U.S. Pat. Nos. 4,141,767; 4,110,134; 3,447,978; Re 28,060; 3,765,964; 3,770,552; 3,715,247; 3,212,945; 3,161,551; 3,376,176, 3,296,044; 3,164,503; and 3,232,019. These blasting agents have certain distinct advantages over conventional blasting agents as explained in U.S. Pat. No. 4,141,767.

Various approaches have been used to obtain cap-sensitivity in water-in-oil emulsion blasting agents. U.S. Pat. No. 3,770,522 suggests that cap-sensitivity can be obtained by adding explosive ingredients such as trinitrotoluene and pentaerythritol tetranitrate to conventional water-in-oil blasting agents. However, the use of these self-explosive ingredients is relatively expensive and requires careful handling. U.S. Pat. Nos. 3,715,247 and 3,765,964 disclose the use of nonexplosive ingredients to render a water-in-oil blasting agent cap-sensitive. These patents disclose the addition of a detonation sensitizer or catalyst, such as an inorganic metal compound of Atomic No. 13 or greater, and strontium compounds, respectively. These ingredients also are relatively expensive. U.S. Pat. No. 4,110,134 discloses the addition of glass microspheres or microbubbles to water-in-oil blasting agents to render them cap-sensitive. Similarly, glass spheres or microbubbles are relatively expensive.

The present invention is an improvement over the compositions of the prior art in that cap-sensitivity can be obtained with an ingredient that is neither hazardous nor expensive but yet that will render water-in-oil blasting agents cap-sensitive. The nonhazardous and relatively inexpensive ingredient is perlite of fine particle size as hereafter described.

Perlite has been used heretofore as a density reducing agent in conventional slurry blasting agents having a continuous aqueous phase and has been suggested for use in water-in-oil blasting agents, e.g., col. 3 of U.S. Pat. No. 3,765,964. This patent, as previously mentioned uses a strontium ion detonation catalyst to obtain cap-sensitivity instead of perlite having a critical particle size as in the present invention. The perlite that has been used or suggested for use heretofore has a significantly larger average particle size than that of the present invention and, consequently, will not render a composition cap-sensitive as will the finer-sized perlite of the present invention, unless perhaps used in such impracticably large quantities that a sufficient number of finer-sized particles are present. This difference in sensitivity is illustrated in examples presented below.

SUMMARY OF THE INVENTION

The composition of the invention comprises a cap-sensitive water-in-oil blasting composition having a water-immiscible liquid organic fuel as a continuous phase, an emulsified aqueous inorganic oxidizer salt solution as a discontinuous phase, an emulsifier, and perlite having an average particle size ranging from about 100 microns to about 150 microns, and preferably from about 100 microns to about 120 microns.

DETAILED DESCRIPTION OF THE INVENTION

The oxidizer salt or salts are selected from the group consisting of ammonium and alkali metal nitrates and perchlorates. The amount of oxidizer salt employed is generally from about 45% to about 94% by weight of the total composition, and preferably from about 60% to about 86%. Preferably, the oxidizer salt is ammonium nitrate (AN) alone (from about 50% to about 80% by weight) or in combination with sodium nitrate (SN) (up to about 30% by weight). However, potassium nitrate perchlorates, and minor amounts of CN can be used.

Preferably all of the oxidizer salt is dissolved in the aqueous salt solution during formulation of the composition. However, after formulation and cooling to ambient temperature, some of the oxidizer salt may precipitate from the solution. Because the solution is present in the composition as small, discrete, dispersed droplets, the crystal size of any precipitated salts will be physically inhibited. This is advantageous because it allows for greater oxidizer-fuel intimacy.

Water is employed in an amount of from about 2% to about 30% by weight, based on the total composition. It is preferably employed in amounts of from about 5% to about 20%, and more preferably from about 8% to about 16%. Water-miscible organic liquids can partially replace water as a solvent for the salts, and such liquids also function as a fuel for the composition. Moreover, certain organic liquids act as freezing point depressants and reduce the fudge point of the oxidizer salts in solution. This can enhance sensitivity and pliability at low temperature. Miscible liquid fuels can include alcohols such as methyl alcohol, glycols such as ethylene glycols, amides such as formamide, and analogous nitrogen-containing liquids. As is well known in the arts, the amount of total liquid used will vary according to the fudge point of the salt solution and the desired physical properties.

The immiscible liquid organic fuel forming the continous phase of the composition is present in an amount of from about 1% to about 10%, and preferably in an amount of from about 3% to 7%. The actual amount used can be varied depending upon the particular immiscible fuel(s) and supplemental fuel(s) (if any) used. When fuel oil or mineral oil are used as the sole fuel, they are preferably used in amount of from about 4% to about 6% by weight. The immiscible organic fuels can be aliphatic, alicyclic, and/or aromatic and can be saturated and/or unsaturated, so long as they are liquid at the formulation temperature. Preferred fuels include mineral oil, waxes, paraffin oils, bezene, toluene, xylenes, and mixtures of liquid hydrocarbons generally referred to as petroleum distillates such as gasoline, kerosene and diesel fuels. Particularly preferred liquid fuels are mineral oil and No. 2 fuel oil. Tall oil, fatty acids and derivatives, and aliphatic and aromatic nitrocompounds also can be used. Mixtures of any of the above fuels can be used. It is particularly advantageous to combine specific fuels with specific emulsifiers as described below.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed above. These additional solid and/or liquid fuels can be added generally in amount ranging up to 15% by weight. If desired, undissolved oxidizer salt can be added to the solution along with any solid or liquid fuels.

The emulsifier of the present invention can be those conventionally employed, and various types are listed in the above-referenced patents. The emulsifier is employed in an amount of from about 0.2% to about 5% by weight. It preferably is employed in an amount of from about 1% to about 3%. A synergism results when particular emulsifiers are combined with particular liquid organic fuels. For example, 2-(8-heptadecenyl)-4,4-bis(hydroxylmethyl)-2-oxazoline in combination with refined mineral oil is a very effective emulsifier and liquid organic fuel system.

The compositions of the present invention are reduced from their natural densities of near 1.5 g/cc, primarily by addition of the perlite of the present invention. The perlite should be dispersed uniformly throughout the composition. Other density reduction agents may be employed. Gas bubbles can be entrained into the composition during mechanical mixing of the various ingredients. A density reducing agent can be added to lower the density by a chemical means. A small amount (0.01% to about 0.2% or more) of a gassing agent such as sodium nitrite, which decomposes chemically in the composition to produce gas bubbles, can be employed to reduce density. Small hollow particles such as glass spheres, styrofoam beads, and plastic microballoons can be added. Two or more of the above-described common gassing means may be employed simultaneously.

The perlite of the present invention has an average particle size ranging from about 100 microns to about 150 microns and preferably from about 100 microns to about 120 microns. Preferably about 90% of the particles are smaller than about 300 microns, more preferably, about 200 microns. The perlite is added in amounts of from about 1% to about 8% by weight based on the total composition, and preferably in amounts of from 2% to 4%. This perlite is available from Grefco, Inc., under the trade designations "GT-23 Microperl," "GT-43 Microperl," and "Dicalite DPS 20." A product from Lehi Block Co. designated "Insulite" also conforms to the specified size range. The physical properties of these products are given below:

| Property | | Value | | | |
|---|---|---|---|---|---|
| Physical Form | | GT-23 Fine Powder | GT-43 Free Flowing Powder | DPS-20 | INSULITE |
| Color | | White | White | White | |
| Bulk Density(lbs/ft$^3$) | | 4–6 | 4–6 | 4.5–7.5 | |
| Average Particle Size, microns | | 110 | 110 | 125–150 | |
| Screen Analysis U. S. Standard Screen | | wt. % | wt. % | wt. % | wt. % |
| | +50 | <1 | <1 | — | — |
| −50 | +70 | 9 | 9 | — | — |
| −70 | +100 | 22 | 22 | — | — |
| −100 | +140 | 27 | 27 | — | — |
| −140 | +200 | 11 | 11 | — | — |
| −200 | +325 | 22 | 22 | — | — |
| −325 | | 10 | 10 | — | — |
| | +20 | — | — | 0 | — |
| −20 | +30 | — | — | <1 | — |
| −30 | +50 | — | — | 9.5 | — |
| −50 | +100 | — | — | 34.5 | — |
| −100 | +200 | — | — | 30.0 | — |
| −200 | +325 | — | — | 16.5 | — |
| −325 | | — | — | 11.5 | — |
| Screen Analysis Tyler | | | | | |
| | +14 | — | — | — | <1 |
| −14 | +20 | — | — | — | 8.7 |
| −20 | +28 | — | — | — | 9.3 |
| −28 | +35 | — | — | — | 10.6 |
| −35 | +48 | — | — | — | 10.4 |
| −48 | +60 | — | — | — | 3.7 |
| −60 | +100 | — | — | — | 15.2 |
| −100 | +150 | — | — | — | 14.2 |
| −150 | +200 | — | — | — | 12.4 |
| −200 | +325 | — | — | — | 10.4 |

-continued

| Property | Value | | | |
|---|---|---|---|---|
| −325 | — | — | — | 4.7 |

One of the main advantages of a water-in-oil blasting agent over a continuous aqueous phase slurry is that thickening and cross-linking agents are not necessary for stability and water resistancy. However, such agents can be added if desired. The aqueous solution of the composition can be rendered viscous by the addition of one or more thickening agents of the type and in the amount commonly employed in the art. Such thickening agents include galactomannin (preferably guar gums); guar gum of reduced molecular weight such as described in U.S. Pat. No. 3,890,171; polyadcylamide and analogous synthetic thickeners; flours; and starches. Biopolymer gums, such as those described in U.S. Pat. No. 3,788,909 also can be used. Thickening agents other than flours and starches are generally used in amount ranging from about 0.05% to about 0.5%, and flours and starches may be employed in much greater amounts, up to about 10%, in which case they also function importantly as fuels. Cross-linking agents for cross-linking the thickening agents also are well known in the art. Such agents are usually added in trace amounts and usually comprise metal ions such as dichromate or antimony ions. The liquid organic, which forms the continuous phase of the composition, also can be thickened, if desired, by use of a thickening agent which functions in an organic liquid. Such thickening agents are well known in the art.

The compositions of the present invention are formulated by preferably first dissolving the oxidizer salt(s) in the water (or aqueous solution of water and miscible liquid fuel) at an elevated temperature of from about 25° C. to about 110° C., depending upon the fudge point of the salt solution. The emulsifier and the immiscible liquid organic fuel then are added to the aqueous solution, preferably at the same elevated temperature as the salt solution, and the resulting mixture is stirred with sufficient vigor to invert the phases and produce an emulsion of the aqueous solution in a continuous liquid hydrocarbon fuel phase. Usually this can be accomplished essentially instantaneously with rapid stirring. (The compositions also can be prepared by adding the aqueous solution to the liquid organic.) Stirring should be continued until the formulation is uniform. The perlite and other solid ingredients if any are then added and stirred throughout the formulation.

It has been found to be particularly advantageous to predissolve the emulsifier in the liquid organic fuel prior to adding the organic fuel to the aqueous solution. Preferably, the fuel and predissolved emulsifier are added to the aqueous solution at about the temperature of the solution. This method allows the emulsion to form quickly and with little agitation.

Sensitivity and stability of the compositions may be improved by passing them through a high-shear system to break the dispersed phase into even smaller droplets prior to adding the perlite. This additional processing through a colloid mill has shown an improvement in rheology and performance.

In further illustration of the invention, Table I contains formulations and detonation results of preferred compositions of the present invention. All of the compositions were cap-sensitive in small diameters.

Table II shows the effect of using varying amounts of perlite of the fine particle size in medium-sized charge diameters. Composition A containing only 0.50% perlite did not produce a stable detonation; however, Composition B containing 0.99% perlite did detonate successfully.

Table III is a comparison of compositions containing various types of perlite. Compositions A–F contained perlite of the required fine average particle size of the present invention, and all of these compositions were cap-sensitive as indicated. Composition G contained perlite of relatively large average particle size and was not cap-sensitive even though it contained as much perlite as that contained in Compositions A–C. Composition H also contained the coarse perlite of Composition G but in a significantly greater quantity. This large quantity was necessary to provide about the same density as Compositions A–F. Because Composition H is shown to be cap-sensitive (although its denotation velocities are lower than those of Compositions A–F), a sufficient quantity of fine particulate perlite was present in the generally coarse mixture to impart such sensitivity. Thus the perlite of Composition H is observed to impart cap-sensitivity only if a very large amount is used.

The compositions of the present invention can be packaged, such as in cylindrical sausage form, or can be directly loaded into a borehole for subsequent detonation. In addition, they can be repumped or extruded from a package or container into the borehole. Depending upon the ratio of aqueous and oil phases, the compositions are extrudable and/or pumpable with convential equipment. However, the viscosity of the compositions may increase with time depending upon whether the dissolved oxidizer salts precipitate from solution and to what extent.

The low temperature, small diameter sensitivity and the inherent water-proofness of the compositions render them versatile and economically advantageous for most application.

While the present invention has been described with reference to certain illustrative examples and preferred embodiments, various modifications will be apparent to those skilled in the art and any such modifications are intended to be within the scope of the invention as set forth in the appended claims.

TABLE I

| COMPOSITION INGREDIENTS (Percent by Weight) | A | B | C | D | E | F |
|---|---|---|---|---|---|---|
| AN | 66.60 | 65.26 | 63.98 | 64.55 | 66.66 | 66.60 |
| SN | 13.32 | 13.05 | 12.80 | 12.91 | 13.33 | 13.32 |
| $H_2O$ | 11.27 | 11.04 | 10.83 | 10.92 | 11.29 | 11.27 |
| Emulsifier[a] | 1.02 | 1.00 | 0.98 | 2.48 | 1.48 | 1.02 |
| Mineral Oil | 4.71 | 4.62 | 4.53 | 4.17 | 4.26 | 4.71 |
| Perlite[b] | 3.07 | 5.02 | 6.89 | — | 2.96 | — |

TABLE I-continued

| COMPOSITION INGREDIENTS (Percent by Weight) | | A | B | C | D | E | F |
|---|---|---|---|---|---|---|---|
| Perlite[c] | | — | — | — | 4.97 | — | — |
| Perlite[d] | | — | — | — | — | — | 6.74 |
| Density (g/cc) | | 1.20 | 1.12 | 1.01 | 1.12 | 1.14 | 1.19 |
| Detonation Results[e]: | | | | | | | |
| 5° C. | 38 mm | #8/4.5 | #8/4.7 | #8/4.5 | — | — | — |
| | 32 mm | #8/4.4 | — | — | #4/4.6 | #8/4.5 | #8/3.5 |
| | 19 mm | #8/4.0 | #8/3.9 | #8/4.0 | #6/3.9 | #8/3.5 | #8/3.3 |
| | 12 mm | — | — | — | #6.3.4 | #8/2.9 | #8/3.0 |
| 20° C. | 38 mm | #8/4.7 | #8/4.6 | #8/4.3 | — | — | — |
| | 19 mm | #8/4.1 | #8/4.1 | #8/4.1 | — | — | #8/2.8 |
| Minimum booster (cap) (Detonate/Fail) | | | | | | | |
| 5° C. | | #4/#3 | #3/#2 | #4/#3 | #4/#3 | #4/#3 | #4/#3 |
| 20° C. | | #4/#3 | #3/#2 | #4/#2 | — | — | #4/#3 |

KEY:
[1]2-(8-heptadecenyl)-4,4-bis(hydroxymethyl)-2-oxazoline
[b]Grefco, Inc. "GT-23 Microperl"
[c]Grefco, Inc. "GT-43 Microperl"
[d]Lehi Block Co. "Insulite"
[e]The first number is the cap number and the decimal number is detonation velocity in km/sec.

TABLE II

| COMPOSITION INGREDIENTS (Percent by Weight) | A | B | C | D | E |
|---|---|---|---|---|---|
| AN | 68.96 | 68.61 | 67.94 | 66.63 | 65.38 |
| SN | 13.71 | 13.66 | 13.53 | 13.27 | 13.02 |
| $H_2O$ | 10.55 | 10.50 | 10.39 | 10.19 | 9.99 |
| Emulsifer[a] | 1.00 | 0.99 | 0.98 | 0.96 | 0.94 |
| Mineral Oil | 5.27 | 5.25 | 5.20 | 5.10 | 4.99 |
| Perlite[b] | 0.50 | 0.99 | 1.96 | 3.85 | 5.66 |
| Density (gm/cc) | 1.39 | 1.34 | 1.32 | 1.23 | 1.15 |
| Detonation Results at 5° C.: | | | | | |
| 124 mm | 2.3[d] | 4.0 | 5.3 | 5.3 | 4.9 |
| 100 mm | 1.5[d] | 4.7 | 5.1 | 5.1 | 5.1 |
| 75 mm | 1.2[d] | 3.3 | 5.1 | D | 4.9 |
| 64 mm | F | 2.1 | 4.7 | — | — |
| 32 mm | F | F | 4.4 | 4.9 | 4.5 |
| Minimum booster (cap) (Detonate/Fail) | #6/#5[e] | #6/#5 | #5/#4 | #6/#5 | #6/#5 |

KEY:
[a]2-(8-heptadecenyl)-4,4-bis(hydroxymethyl)-2-oxazoline.
[b]Grefco, Inc. "Dicalite DPS-20"
[c]The decimal number is detonation velocity in km/sec. F = failure, D = detonation.
[d]These low average velocities are indicative of incomplete detonation.
[e]Detonation for minimum booster based upon noise level and absence of unreacted blasting agent, but stable detonation questionable in view of low velocities.

TABLE III

| COMPOSITION INGREDIENTS (Percent by Weight) | | A | B | C | D | E | F | G | H |
|---|---|---|---|---|---|---|---|---|---|
| AN | | 66.60 | 66.60 | 66.60 | 66.60 | 66.60 | 66.60 | 66.60 | 62.99 |
| SN | | 13.32 | 13.32 | 13.32 | 13.32 | 13.32 | 13.32 | 13.32 | 12.60 |
| $H_2O$ | | 11.27 | 11.27 | 11.27 | 11.27 | 11.27 | 11.27 | 11.27 | 10.66 |
| Emulsifier[a] | | 1.02 | 1.02 | 1.02 | 1.02 | 1.02 | 1.02 | 1.02 | 0.96 |
| Mineral Oil | | 4.71 | 4.71 | 4.71 | 4.71 | 4.71 | 4.71 | 4.71 | 4.45 |
| Perlite[b] | | 3.07 | — | — | 4.0 | — | — | — | — |
| Perlite[c] | | — | 3.07 | — | — | 4.0 | — | — | — |
| Perlite[d] | | — | — | 3.07 | — | — | 4.0 | — | — |
| Perlite[e] | | — | — | — | — | — | — | 3.07 | 8.33 |
| Density (g/cc) | | 1.26 | 1.27 | 1.33 | 1.22 | 1.19 | 1.19 | 1.33 | 1.21 |
| Detonation Results[f]: | | | | | | | | | |
| 20° C. | 64 mm | — | #4/4.9 | — | #4/4.9 | #5/5.1 | #4/D | #8/F | — |
| | 50 mm | #6/4.0 | — | #5/3.8 | — | #4/4.0 | — | #8/F | #8/3.5 |
| | 38 mm | #8/4.5 | — | #8/3.1 | — | — | — | #8/F | — |
| | 32 mm | #8/4.4 | #8/3.7 | #8/3.0 | — | #8/3.6 | #8/3.6 | #8/F | #8/3.0 |
| | 25 mm | #8/3.7 | #8/F | #8/F | #8/4.0 | #8/3.3 | #8/4.0 | — | #8/3.0 |
| | 19 mm | #8/2.8 | — | — | #8/F | #8/3.3 | #8/2.8 | — | #8/3.0 |
| 5° C. | 64 mm | — | — | #6/2.3 | — | #4/4.9 | #4/D | #8/F | — |
| | 50 mm | — | #5/4.7 | — | #4/5.1 | — | — | #8/F | — |
| | 38 mm | #8/4.7 | #8/3.8 | #8/3.0 | — | — | — | #8/F | #8/3.2 |
| | 32 mm | #8/4.4 | #8/F | #8/F | — | — | #8/3.5 | #8/F | #8/3.0 |
| | 25 mm | — | — | — | #8/4.2 | #8/4.1 | #8/3.3 | — | #8/2.5 |
| | 19 mm | #8/F | — | — | #8/4.0 | #8/3.4 | #8/3.0 | — | #8/F |

TABLE III-continued

| | | | | | | | | |
|---|---|---|---|---|---|---|---|---|
| Minimum booster (Detonate/Fail) | | | | | | | | |
| 20° C. | #6/#5 | #4/#3 | #5/#4 | #4/#3 | #4/#3 | #4/#3 | F[g] | #5/#4 |
| 5° C. | #8/#6 | #5/#4 | #6/#5 | #4/#3 | #4/#3 | #4/#3 | F[h] | #6/#5 |

KEY:

[a]same as in Tables I and II
[b]Grefco, Inc. "GT-23 Microperl"
[c]Grefco, Inc. "Dicalite DPS-20"
[d]Lehi Block Company "Insulite"
[e]Pax Company "Paxlite"

Screen Analysis

| Tyler | | wt. % | | | wt. % |
|---|---|---|---|---|---|
| | +8 | 21.0 | −35 | +48 | 4.6 |
| −8 | +10 | 16.2 | −48 | +60 | 1.6 |
| −10 | +14 | 13.0 | −60 | +100 | 3.6 |
| −14 | +20 | 9.4 | −100 | +150 | 2.6 |
| −20 | +28 | 7.0 | −150 | +200 | 2.6 |
| −28 | +35 | 6.2 | −200 | +325 | 4.2 |
| | | | −325 | | 8.0 |

[f]The first number is the cap number, F = failure, D = detonation, and the decimal number is detonation velocity in km/sec.
[g]Failed with a 170 g pentolite booster
[h]Failed with a #8 cap and detonated with a 40 g pentolite booster

We claim:

1. A cap-sensitive water-in-oil emulsion blasting composition comprising a water-immiscible liquid organic fuel as a continuous phase, an emulsified aqueous inorganic oxidizer salt solution as a discontinuous phase, an emulsifier, and perlite in an amount of from about 1.0% to about 8% by weight based on the total composition having an average particle size ranging from about 100 microns to about 150 microns as a sensitizing agent and a density reducing agent in amount sufficient to reduce the density of the composition to within the range of from about 0.9 to about 1.4 g/cc and to render the composition cap-sensitive.

2. A blasting composition according to claim 1 wherein about 90% of the perlite particles are smaller than about 300 microns.

3. A blasting composition according to claim 1 wherein the perlite has an average particle size ranging from about 100 microns to about 120 microns and about 90% of the particles are smaller than about 200 microns.

4. A blasting composition according to claim 2 wherein the perlite is present in an amount of from about 2% to about 4% by weight based on the total composition.

5. A blasting composition according to claim 1 wherein the liquid organic fuel is selected from the group consisting of mineral oil, waxes, benzene, toluene, xylene, and petroleum distillates such as gasoline, keosene, and diesel fuels.

6. A blasting composition according to claim 2 wherein the liquid organic fuel is mineral oil.

7. A blasting composition according to claim 1 containing an additional density reducing agent selected from the group consisting of small, dispersed glass or plastic spheres or microballoons; a chemical foaming or gassing agent; and a combination of each.

8. A cap-sensitive water-in-oil emulsion blasting composition comprising a water-immiscible liquid organic fuel as a continuous phase in an amount of from about 1% to about 10% by weight based on the total composition; an emulsified aqueous inorganic oxidizer salt solution comprising water in an amount from about 5% to about 20% and inorganic oxidizer salt in an amount from about 60% to about 94%; an emulsifier in an amount from about 0.2% to about 5.0%, and perlite having an average particle size ranging from about 100 microns to about 120 microns in an amount of from about 1% to about 8%.

9. A blasting composition according to claim 8 wherein the oxidizer salt solution contains additionally from about 1% to about 10% of a water-miscible organic liquid fuel.

10. A blasting composition according to claim 9 wherein about 90% of the perlite particles are smaller than about 200 microns.

11. A blasting composition according to claim 9 wherein the perlite is present in an amount of from about 2% to about 4%.

* * * * *